US006805533B2

(12) United States Patent
Schopf

(10) Patent No.: US 6,805,533 B2
(45) Date of Patent: Oct. 19, 2004

(54) TOLERANT INTERNALLY-COOLED FLUID GUIDE COMPONENT

(75) Inventor: Cheryl A. Schopf, Jupiter, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/256,798

(22) Filed: Sep. 27, 2002

(65) Prior Publication Data

US 2004/0062649 A1 Apr. 1, 2004

(51) Int. Cl.[7] ..... F01D 5/18
(52) U.S. Cl. ..... 416/97 R; 416/96 A
(58) Field of Search ..... 416/90 R, 97 A, 416/97 R, 96 A, 96 R; 415/115

(56) References Cited

U.S. PATENT DOCUMENTS 3,799,696 A 3/1974 Redman
4,063,851 A * 12/1977 Weldon ..... 416/97 A
4,616,976 A 10/1986 Lings et al.
5,193,975 A * 3/1993 Bird et al. ..... 415/115
5,688,104 A 11/1997 Beabout
5,931,638 A 8/1999 Krause et al.
6,036,441 A * 3/2000 Manning et al. ..... 416/97 R
6,243,948 B1 6/2001 Lee et al.
6,283,708 B1 9/2001 Zelesky
6,287,075 B1 9/2001 Kercher
6,368,060 B1 4/2002 Fehrenbach et al.

* cited by examiner

*Primary Examiner*—Edward K. Look
*Assistant Examiner*—Dwayne White

(57) ABSTRACT

A cooled fluid flow component for a combustion engine which employs internal impingement and exterior surface film cooling is disclosed. The fluid flow component has improved tolerance to assembly and manufacturing variations. The fluid flow component includes at least one interior cavity having an associated impingement sleeve. An impingement annulus surrounding the impingement sleeve is divided into more than one region, with each region forced to have a pressure equal, pressure, with the pressure induced being sufficient to provide adequate backflow margin. The external cooling holes are shaped to address possible overflow tendencies, and the impingement holes are adapted to reduce or eliminate possible losses of impingement cooling effectiveness.

16 Claims, 3 Drawing Sheets

TOLERANT INTERNALLY-COOLED FLUID GUIDE COMPONENT

FIELD OF THE INVENTION

This invention relates generally to the field of internal to combustion engines and, more particularly, to a flow guide component having improved tolerance to assembly and manufacturing variations.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to the energy conversion process. In gas turbine engines, air discharged from a compressor section and fuel introduced from a fuel supply are mixed together and burned in a combustion section. The products of combustion are harnessed and directed through a turbine section, where they expand and turn a central rotor shaft. The rotor shaft may, in turn, be linked to devices such as an electric generator to produce electricity.

To increase efficiency, engines are typically operated near the limits of the engine components. For example, to maximize the amount of energy available for conversion into electricity, the products of combustion (also referred to as the working gas or working fluid) often exit the combustion section at high temperature. This elevated temperature generates a large amount of potential energy, but also places a great deal of stress on the downstream fluid guide components, such as the blades and vanes of the turbine section. In an effort to help these components withstand this temperature these blades and vanes are often cooled.

In fluid guide components with an internal impingement and external surface (leading edge showerhead and side film) cooling design, a basic concern is the maintenance sufficient backflow margin. This means ensuring that the pressure supplying the showerhead surface holes is maintained above the external static pressure in the leading edge region during all operating ranges. This backflow requirement must be met while simultaneously ensuring that the fluid guide component side walls are also sufficiently cooled. Traditionally, a perforated impingement tube or insert in conjunction with dams or other sealing partitions or is used to accomplish this. The dams help isolate the leading edge cooling region and associated cooling holes from influences which might jeopardize the backflow margin, including manufacturing imperfections or assembly misalignment within the side wall cooling regions, fluctuations in external static pressure, and variation induced by permitted manufacturing tolerances, including cooling hole size and location. This isolation is beneficial because the cooling holes in the leading edge and side regions are typically fed from the same cooling cavity. The dams also create flow-wise separated regions so that the desired impingement pressure ratios can be generated to provide the necessary internal cooling along the fluid guide component sidewalls. The dams also provide a means of positioning the insert. Accordingly, sealing dams provide performance and assembly benefits, in some cases. Unfortunately, sealing dams often do not perform as expected.

In practice, manufacturing tolerances often result in the dams being incorrectly positioned or improperly sized. Also, impingement inserts are often installed during a so-called "blind" assembly, which is difficult to observe directly. As a result, it is difficult to ensure that the impingement inserts are correctly positioned. If an impingement tube is installed or manufactured incorrectly, associated impingement holes may be blocked or leakage around the sealing dams may occur. Misalignment or other incorrect insert assembly can significantly reduce the available impingement cooling, with the further result of jeopardizing the backflow margin of the leading edge cooling region. Failures of this type may result in reduced life of the fluid guide component or even complete failure of the component.

Therefore, there remains a need in this art for a fluid guide component that meets cooling requirements while remaining insensitive to the presence of sealing dams or positioning members and minimizing the necessary cooling flow requirements for a given engine performance. The component should include hollow portions or cavities having impingement hole arrays sized so that substantially-uniform pressure is obtained on the downstream side of the impingement insert on all sides of associated positioning members or sealing dams. This pressure obtained within each cavity should meet the minimum back flow requirements for the highest external pressure encountered by the given cavity. The component should also address possible losses in impingement cooling effectiveness, as well as issues related to overflowing of the external cooling holes.

SUMMARY OF THE INVENTION

The present invention is a flow guide component having improved tolerance to assembly and manufacturing variations. The guide component includes features that reduce or eliminate sensitivity to the presence of the insert seals, dams, or positioning members, while minimizing the necessary cooling flow requirements for a given engine performance.

Accordingly, it is an object of the present invention to provide a fluid guide component for a combustion engine that ensures substantially-uniform pressure is obtained on the downstream side of an impingement insert on all sides of the associated positioning members or sealing dams.

It is a further object of the present invention to provide a fluid guide component for a combustion engine that address possible losses in impingement cooling effectiveness.

It is an additional object of the present invention to provide a fluid guide component for a combustion engine that addresses possible overflowing of the external cooling holes.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

DETAILED DESCRIPTION OF THE INVENTION

Figure 1:
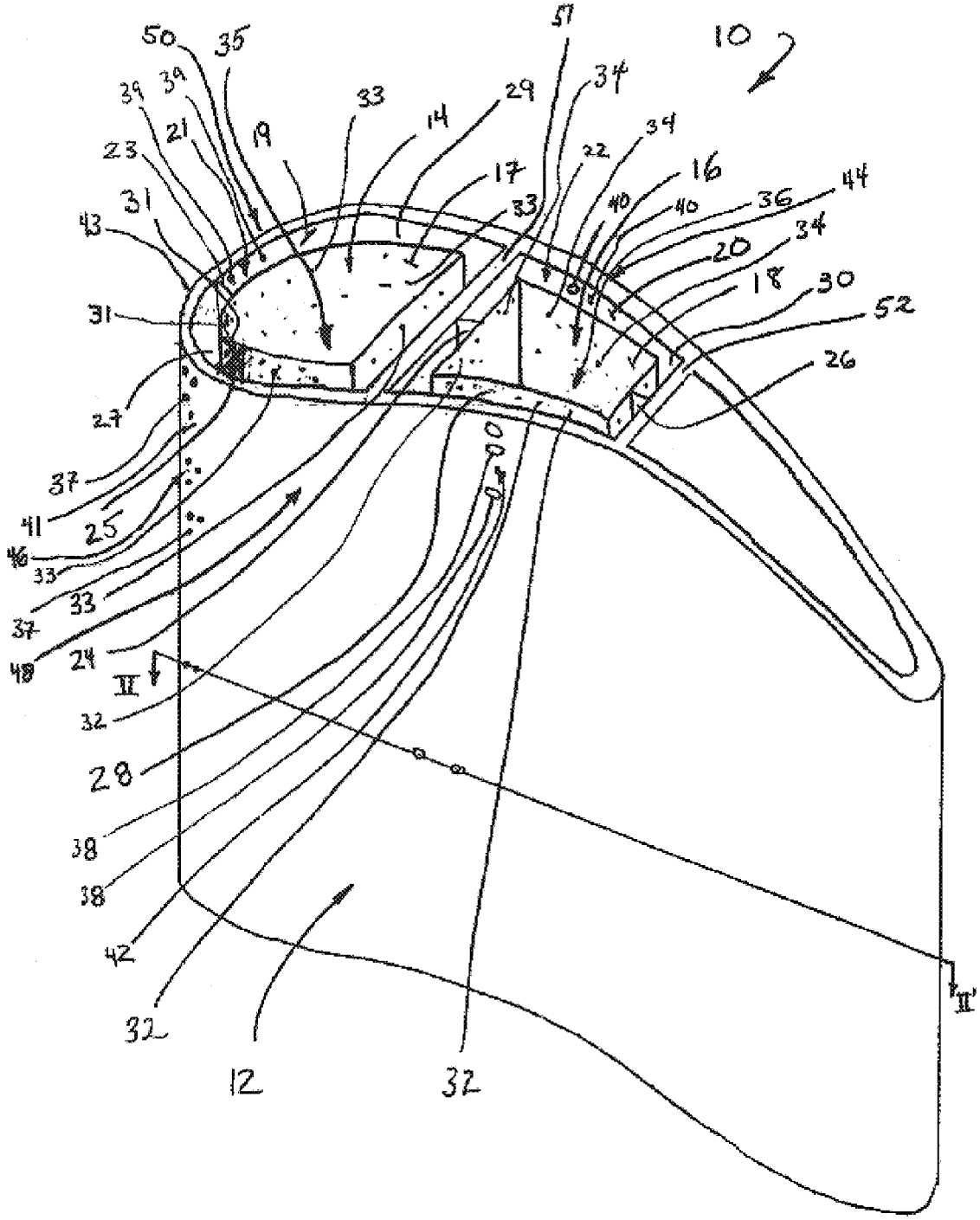
FIG. 1 is an isometric view of the fluid guide component of the present invention.

Reference is made to the Figures, generally, in which a fluid guide component 10 according to the present invention is shown. By way of overview, the component 10 is internally cooled and includes a body member 12 having forward and middle hollow portions 14,16; an impingement sleeve 17,18 is mounted in each of the hollow portions. The impingement sleeves 17,18 are spaced apart from the inner surface 19,20 of the corresponding hollow portion 14,16, each forming an impingement annulus 21,22 which surrounds the corresponding impingement sleeve. In each impingement annulus 21,22, first and second pairs of partition elements 23,25 and 24,26 divide the annulus into two distinct regions 27,29 and 28,30. Additionally, each impingement sleeve 17,18 includes two groups of impingement holes or ports 31,33 and 32,34 that fluidly connect the corresponding first and second impingement regions 27,29 and 28,30 with a flow channel 35,36 located within the corresponding impingement sleeve 17,18. The flow channels 35,36 are, in turn, adapted for connection to a source of cooling fluid, such as air provided by an upstream source, such as a compressor (not shown) or combustor (not shown). Similarly, groups of surface cooling holes 37,39 and 38,40 are disposed within corresponding exterior cooling regions 41,43 and 42,44 associated with each hollow portion 14,16. During operation, each of the forward exterior cooling regions 41,43 experience substantially-different pressures, with each of the middle exterior cooling regions 42,44 also encountering substantially-different pressures. In this application, the term "substantially-different pressures" refers to pressures which differ by about 10% or greater. The present invention is suited, for example for use in environments in which the pressure in the forward first exterior cooling regions 41,42 is about 115% of the pressure in the forward second exterior cooling regions 43,44; the present invention is also suited for pressure variations of about 50%, such as between middle first exterior cooling regions 42 and middle second exterior cooling regions 44.

In keeping with the objects of the invention, and as will be described more fully below, the groups of impingement holes 31,33 and 32,34 are adapted to ensure that substantially-equal pressure is obtained within each impingement region 27,29 and 28,30, even though this means that each corresponding second impingement region 29,30 will receive more pressure than is typically required to provide surface cooling of those regions and that the impingement cooling effectiveness in each hollow portion 14,16 may be reduced. This arrangement ensures that a sufficient backflow margin is maintained, regardless of variations in the impingement sleeve 18 manufacture or misalignment of sleeve during insertion into the hollow portions 14,16. Tendencies for overflow of the second groups of surface cooling holes 37,38, as well as measures to improve impingement cooling are advantageously provided, as discussed below. The fluid guide component 10 according to the present invention will now be described in detail.

Figure 2:
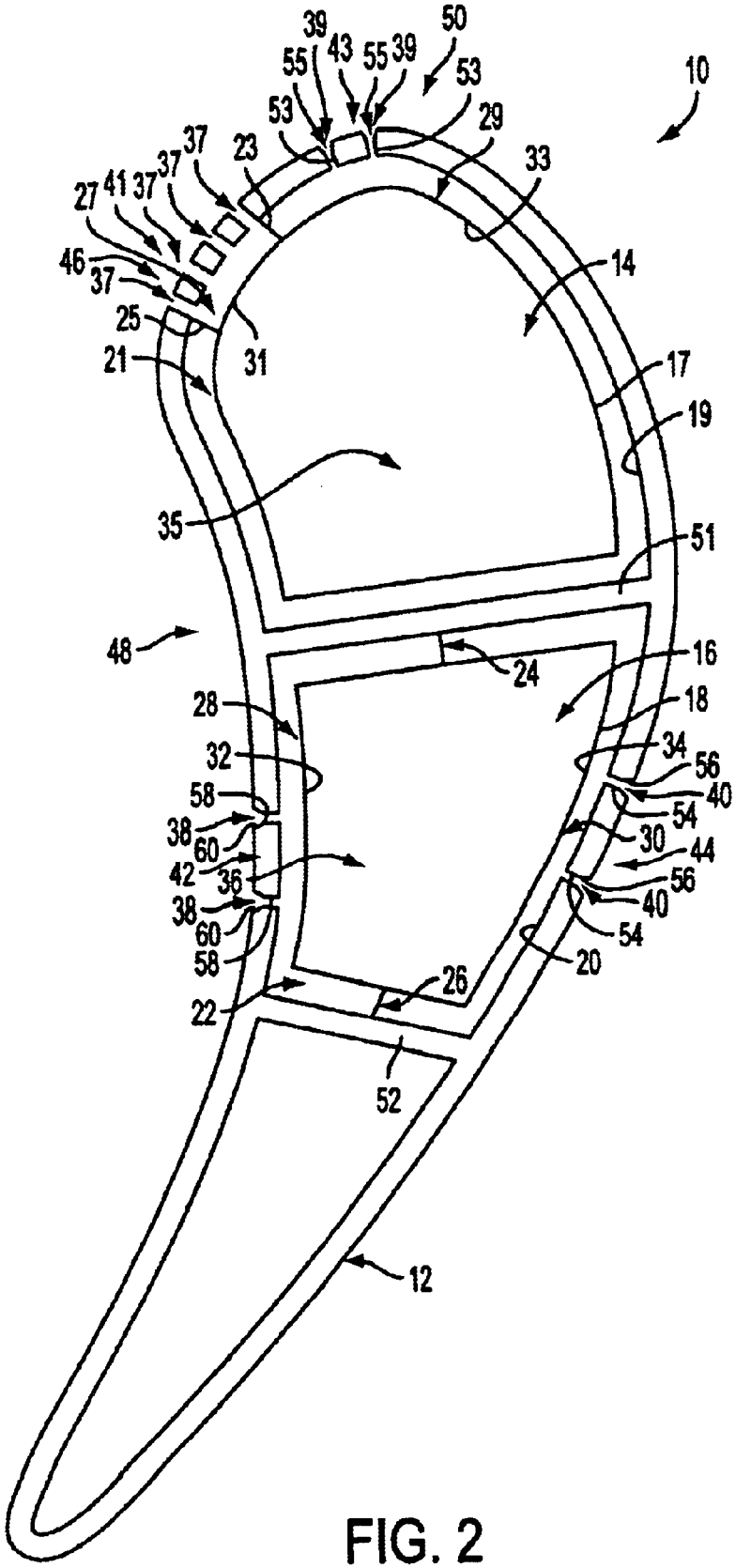
FIG. 2 is a cross-section end view of the fluid guide component shown in FIG. 1, taken along cutting plane II–II' therein.

With particular reference to FIGS. 1 and 2, the fluid guide component of the present invention 10 is a vane for use in an industrial combustion turbine engine (not shown). The body member 12 is elongated and substantially-airfoil shaped. The body member 12 includes a leading edge region 46, a pressure side region 48, and a suction side region 50. The body member 12 includes forward and middle hollow portions 14,16 defined by cavity barriers or ribs 51,52 which extend across the interior of the body member, connecting the body member pressure side region 48 and suction side region 50. It is noted that the body member 12 need not include two hollow portions 14,16, and may include fewer, or more, hollow portions if desired.

As seen with continued reference to FIGS. 1 and 2, the forward hollow portion 14 includes an impingement sleeve 17 spaced apart from the hollow portion inner surface 19. A set of partition elements or dams 23,25, extend between the hollow portion inner surface 19 and the impingement sleeve 18. These partition elements 23,25 divide the forward impingement annulus, which is located between the forward impingement sleeve 17 and forward hollow portion inner surface 19, into two impingement regions 27,29.

With particular reference to FIG. 2, the forward partition elements 23,25 are substantially aligned with the edges of the body portion leading edge region 46. With this arrangement, the forward first impingement region 27 is substantially coextensive with the body portion leading edge region 46. Accordingly, the forward second impingement region 29 extends around the forward impingement sleeve 17, except for the region bounded by the forward partition elements 23,25. With this arrangement, the forward first impingement region 27 accounts for about 5% to 10% of the total volume of the forward impingement annulus 21. It is noted that several pairs of dams may be used if more than two impingement regions are desired. It is also noted that the partition elements 23,25 need not seal the impingement regions from each other; stand-offs, dimples or other suitable non-sealing members may also be used.

Figure 3:
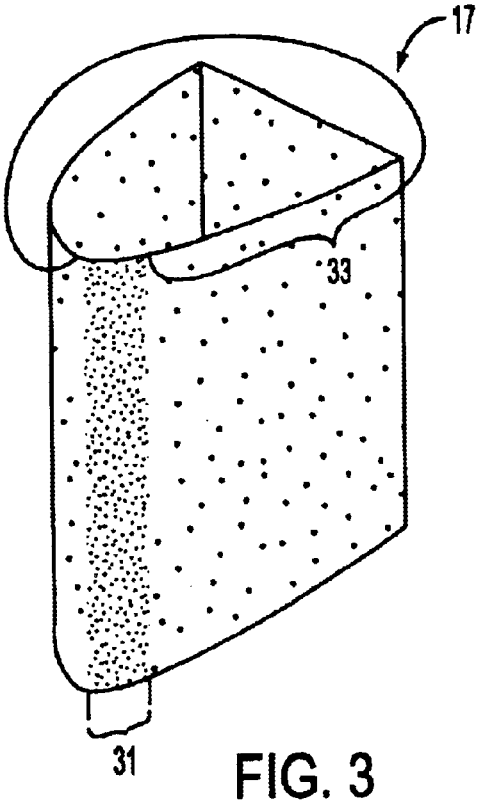
FIG. 3 is an alternate isometric view of an impingement sleeve used in a forward hollow portion of the present invention.

With particular reference to FIG. 3, the forward impingement sleeve 17 includes two groups of impingement holes or ports 31,33, with each group being associated with one of the forward impingement regions 27,29 described above. The forward first group of impingement ports 31 fluidly connects the forward first impingement 27 region with the forward flow channel 35, while the forward second group of impingement ports 33 fluidly connects the forward second impingement 29 region with the forward flow channel. In keeping with the objects of the invention, the pressure within the forward first impingement region 27 is forced to be the same as the pressure within the forward second impingement region 29. In one embodiment, this pressure equality is ensured by setting the flow per unit area within the forward first group of impingement ports 31 to be substantially equivalent to the flow per unit area within the forward second group of impingement ports 33. The pressure produced in both impingement regions 27,29 is sufficient to maintain the backflow margin required for proper surface cooling of the leading edge region 46. This arrangement advantageously ensures that gaps between the forward set of partition elements 23,25 and the forward impingement sleeve 17 do not interfere with surface cooling of the body member 12. Although these pressures vary, one appropriate backflow margin range is between about 2% and 5%. An appropriate range for forward impingement annulus pressure ratio would be about 25% to 33% of the backflow-margin. In one embodiment, the pressure adjacent the forward first exterior cooling holes 37 is within the range of about 1585–1800 Kpa, the pressure adjacent the forward second exterior cooling holes 39 is within the range of about 1200–1485 Kpa, and the pressure within the forward flow channel is within the range of about 1585–1800 KPa.

With reference again to FIG. 2, the forward first set of exterior cooling holes 37 are located within the body portion leading edge region 46 and are exposed to a pressure in the range of no more than about 98% of the pressure within the first flow channel 35. The forward first set of exterior cooling holes 37 have a cylindrical cross section and have a diameter in the range of about 0.5 mm to about 1.0 mm. The forward second set of exterior cooling holes 39 are located within the body portion suction side region 50 and are exposed to pressures in a range that is about 10% to about 40% below the pressures experienced by the holes 37 in the first exterior cooling region 41. The forward second set of exterior cooling holes 39 have a cylindrical region 53 and a flared portion 55. The cylindrical 53 portions have a diameter in the range of about 0.5 mm to about 1 mm. The flared portion 55 is characterized as being stretched or extended in the flow-wise direction, the radially-upward direction, and the radially-downward direction. With this arrangement, the forward sets of exterior cooling holes 37,39 cooperatively provide adequate film cooling of the body member 12, while the second set of holes is particularly suited for reducing the flow which exits those holes. In keeping with the objects of the present arrangement, this combination advantageously addresses the tendency for the higher-than-required pressure within the forward second impingement region 29 to introduce above-optimum flow rates and associated engine performance issues. It is noted that the forward second exterior cooling region 43 and the associated cooling holes 39 need not be in the suction side region 50; they may be located elsewhere, including the pressure side region 48. The first and second groups of exterior cooling holes 37,39 need not be uniform and each group may include combinations of round and flared cross-sections.

In order to maximize impingement cooling effectiveness within the forward impingement annulus 21, the forward groups of impingement ports are adapted to induce a flow per unit area sufficient to produce effective impingement cooling. For example, each of the forward first group of impingement ports 31 would have a flow within the range of about 0.06–0.13 kg/s and an area within the range of about 100–250 $mm^2$ If the ports 31 were circular, each would have a diameter of approximately 0.8 mm to about 1.6 mm. The forward second group of impingement ports 33 would have a flow within the range of about 0.21–0.28 kg/s and an area within the range of about 350–500 $mm^2$. If the ports 33 were circular, each would have a diameter of approximately 0.8 mm to about 1.6 mm.

As seen with continued reference to FIGS. 1 and 2, the middle hollow portion 16 includes an impingement sleeve 18 spaced apart from the hollow portion inner surface 20. A set of partition elements or dams 24,26, extend between the hollow portion inner surface 20 and the impingement sleeve 18. These partition elements 24,26 divide the middle impingement annulus 22, which is located between the middle impingement sleeve 18 and middle hollow portion inner surface 20, into two impingement regions 28,30.

With particular reference to FIG. 2, the middle partition elements 24,26 extend from the cavity barriers 51,52 to the impingement sleeve 18. With this arrangement, the middle first impingement region 28 is associated with the body portion pressure side region 48. The middle second impingement region 30 is, in turn, associated with the body portion suction side region 50. With this arrangement, the middle first impingement region 28 accounts for approximately 50% of the total volume of the middle impingement annulus 22. It is noted that several pairs of dams may be used if more than two impingement regions are desired. It is also noted that the partition elements 24,26 need not seal the impingement regions from each other; stand-offs, dimples or other suitable non-sealing members may also be used.

Figure 4:
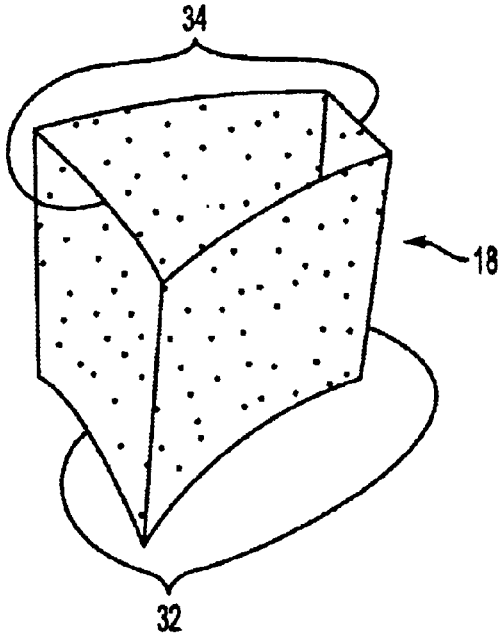
FIG. 4 is an alternate isometric view of an impingement sleeve used in a middle hollow portion of the present invention.

With particular reference to FIG. 4, the middle impingement sleeve 18 includes two groups of impingement holes or ports 32,34, with each group being associated with one of the middle impingement regions 28,30 described above. The middle first group of impingement ports 32 fluidly connects the middle first impingement 28 region with the middle flow channel 36, while the middle second group of impingement ports 34 fluidly connects the middle second impingement 30 region with the middle flow channel. In keeping with the objects of the invention, the pressure within the middle first impingement region 28 is forced to be the same as the pressure within the middle second impingement region 30. In one embodiment, this pressure equality is ensured by setting the flow per unit area within the middle first group of impingement ports 32 to be substantially equivalent to the flow per unit area within the middle first group of impingement ports 34. The pressure produced in both impingement regions 28,30 is sufficient to maintain the backflow margin required for proper surface cooling of the body portion 12. This arrangement advantageously ensures that gaps between the middle set of partition elements 24,26 and the middle impingement sleeve 18 do not interfere with surface cooling of the body member 12. Although these pressures vary, appropriate associated backflow margins are within the range of about 3% to about 7% of the external pressure in this region. In one embodiment, the pressure adjacent the middle first exterior cooling holes 37 is within the range of about 1450–1650 KPa, the pressure adjacent the middle second exterior cooling holes 39 is within the range of about 860–1210 KPa, and the pressure within the middle flow channel is within the range of about 1585–1800 KPa.

With reference again to FIG. 2, the middle first set of exterior cooling holes 38 are located within the body portion pressure side region 48 and are exposed to a pressure in the range of about 97% of the pressure within the middle first impingement region 28. The middle first set of exterior cooling holes 38 have a cylindrical portion 58 and a flared portion 60. The cylindrical portions 58 have a diameter in the range of about 0.5 mm to about 1.0 mm. The flared portion 60 is characterized as being stretched or extended in the flow-wise direction, the radially-upward direction, and the radially-downward direction. The middle second set of exterior cooling holes 40 are located within the body portion suction side region 50 and are exposed to pressures in a range that is about 40% to about 60% below the pressures experienced by the holes 38 in the first exterior cooling region 42. The middle second set of exterior cooling holes 40 have a cylindrical region and a flared portion. The cylindrical portions have a diameter in the range of about 0.5 mm to about 1.0 mm. The flared portion is characterized as being stretched or extended in the flow-wise direction, the radially-upward direction, and the radially-downward direction. With this arrangement, the middle sets of exterior cooling holes 38,40 provide adequate film cooling of the body member 12, while reducing the flow which exits those holes. In keeping with the objects of the present arrangement, this combination advantageously addresses the tendency for the higher-than-required pressure within the middle second impingement region 30 to introduce above-optimum flow rates and associated engine performance issues. It is noted that the middle first and second groups of exterior cooling holes 38,40 need not be uniform and each group may include combinations of round and flared cross-sections.

In order to maximize impingement cooling effectiveness within the middle impingement annulus 22, the middle groups of impingement ports are adapted to induce a flow per unit area sufficient to produce effective impingement cooling. For example, each of the middle first group of impingement ports 32 would have a flow of about 0.04–0.08 kg/s and an area in the range of 60–100 $mm^2$. The middle second group of impingement ports 34 would have a flow of about 0.04–0.08 kg/s and an area in the range of about 60–100 $mm^2$.

It is to be understood that while certain forms of the invention have been illustrated and described, it is not to be limited to the specific forms or arrangement of parts herein described and shown. It will be apparent to those skilled in the art that various, including modifications, rearrangements and substitutions, may be made without departing from the scope of this invention and the invention is not to be considered limited to what is shown in the drawings and described in the specification. The scope if the invention is defined by the claims appended hereto.

What is claimed is:

1. An internally-cooled fluid flow component for a combustion engine comprising:

an airfoil-shaped body member including a loading edge region, a suction side region, and a pressure side region;

a hollow portion disposed within said body member;

an impingement sleeve disposed within said hollow portion, said impingement sleeve being spaced apart from an inner surface of said hollow portion, thereby forming an impingement annulus between said impingement sleeve and said inner surface, said impingement annulus substantially surrounding said impingement sleeve, a flow channel disposed within said impingement sleeve, said flow channel being adapted for fluid communication with a source of cooling fluid;

first and second partition elements each spanning said impingement annulus, said partition elements cooperatively dividing said impingement annulus into a first impingement region and a second impingement region said first region being substantially within leading edge, and said second impingement region lying at least partially within both of said suction and pressure side regions;

a first group of impingement ports disposed within said impingement sleeve and in fluid communication with said first impingement region, said first group of impingement ports defining a first total passthrough area;

a second group of impingement ports disposed within said impingement sleeve and in fluid communication with said second impingement region, said second group of impingement ports being adapted to deliver cooling fluid to both of said suction and pressure side regions with a substantially equal amount of pressure and defining a second total passthrough area, said first and second total passthrough areas being substantially equal;

a first group of surface cooling parts disposed substantially within said leading edge region and in fluid communication with said first impingement region a second group of surface cooling ports disposed substantially outside of said leading edge region and in fluid communication with said second impingement region, whereby said first and second groups of impingement ports are adapted to produce substantially equal pressure within said first and second impingement region when fluid flows through said flow channel and into said impingement regions.

2. The internally-cooled fluid flow component for a combustion engine of claim 1, wherein said component is adapted to encounter a first pressure within said first impingement region, a second pressure within said second impingement region, and a third pressure within said flow channel, with said first and second pressures being equal to about 99% of said third pressure.

3. The internally-cooled fluid flow component for a combustion engine of claim 2, wherein said third pressure is in the range of about 1585–1800 Kpa.

4. The internally-cooled fluid flow component for a combustion engine of claim 2, wherein said first group of impingement holes are substantially circular and have a diameter within the range between about 0.8 mm to about 1.6 mm, whereby said first group of impingement holes is adapted to produce a flow per unit area sufficient to effectively cool said first impingement region.

5. The internally-cooled fluid flow component for a combustion engine of claim 2, wherein said second group of impingement holes are substantially circular and have a diameter within the range between about 0.8 mm to about 1.6 mm, whereby said first group of impingement holes is adapted to produce a flow per unit area sufficient to effectively cool said second impingement region.

6. The internally-cooled fluid flow component for a combustion engine of claim 1, wherein said component is adapted for use in a combustion engine which induces a first external pressure adjacent said first group of surface cooling ports and a second external pressure adjacent said second group of surface cooling ports, said first external pressure being approximately 115% of the second pressure.

7. The internally-cooled fluid flow component for a combustion engine of claim 6, wherein said first external pressure is within a range between about 1515–1725 Kpa.

8. The internally-cooled fluid flow component for a combustion engine of claim 6, wherein said second external pressure is within a range between about 1200–1485 KPa.

9. An internally-cooled fluid flow component for a combustion engine comprising:

a hollow airfoil having a leading edge region defined by a pair of partition elements, a first side region, a second side region, and including a first cooling, port in said leading edge region and a second cooling port outside of said leading edge region;

a first set of impingement ports having a first total area and being in fluid communication with a first impingement region disposed within said leading edge region;

a second set of impingement ports having a second total area and being in fluid communication with a second impingement region at least partially within both of said suction and sure side regions, said second set of ports being adapted to deliver cooling fluid to both of said suction and pressure side regions with a substantially equal amount of pressure and, wherein said first and second total areas are substantially equal, whereby said first and second sets of impingement holes are adapted to provide fluid at a equal pressure to each of said impingement regions.

10. An internally-cooled fluid flow component for a combustion engine comprising:

an airfoil-shaped body member including a leading edge region, a first side region, and a second side region;

a hollow portion disposed within said body member;

an impingement sleeve disposed within said hollow portion, said impingement sleeve being spaced apart from an inner surface of said hollow portion, thereby forming an impingement annulus between said impingement sleeve and said inner surface, said impingement annulus substantially surrounding said impingement sleeve;

a flow channel disposed within said impingement sleeve, said flow channel being adapted for fluid communication with a source of cooling fluid;

said impingement annulus including a first impingement region at least partially aligned with said first side region and a second impingement region at least partially aligned with said second side region;

a first group of impingement ports disposed within said impingement sleeve and in fluid communication with said first impingement region, said first group of impingement ports defining a first total passthrough area;

a second group of impingement ports disposed within said impingement sleeve and in fluid communication with said second impingement region, said second group of impingement ports defining a second total passthrough area, said first and second total passthrough areas being substantially equal, and said first and second groups of impingement ports being adapted to deliver cooling fluid to both of said suction and pressure side regions with a substantially equal amount of pressure;

a first group of surface cooling ports disposed substantially within a first exterior cooling region and in fluid communication with said first impingement region; and a second group of surface cooing ports disposed substantially a second exterior cooling region and in fluid communication with said second impingement region, whereby said first and second groups of impingement ports are adapted to produce substantially equal pressure within said first and second impingement region when fluid flows through said flow channel and into said impingement regions.

11. The internally-cooled fluid flow component for a combustion engine of claim 10, wherein said first and second impingement regions are defined by first and second spacing elements disposed within said impingement annulus.

12. The internally-cooled fluid flow component for a combustion engine of claim 10, wherein said component is adapted for use in a combustion engine which induces a first external pressure adjacent said first group of surface cooling ports and a second external pressure adjacent said second group of surface cooling ports, said first external pressure being approximately 115% of the second external pressure.

13. The internally-cooled fluid flow component for a combustion engine of claim 12, wherein said first external pressure is within a range between about 1450–1650 Kpa.

14. The internally-cooled fluid flow component for a combustion engine of claim 12, wherein said second external pressure is within a range between about 860–1210 KPa.

15. The internally-cooled fluid flow component for a combustion engine of claim 12, wherein said first exterior cooling region is within said pressure side region and said second exterior cooling region is within said suction side region.

16. The internally-cooled fluid flow component for a combustion engine of claim 15, wherein said first exterior pressure is the range of about 1450–1650 Kpa and said second exterior pressure is in the range of about 860–1210 KPa.

* * * * *